United States Patent [19]

Turner

[11] 3,949,718

[45] Apr. 13, 1976

[54] ENGINE SPARK IGNITION SYSTEM CORONA COUPLER

[76] Inventor: James E. Turner, 720 S. Kimball, Southlake, Tex. 76051

[22] Filed: May 21, 1974

[21] Appl. No.: 471,865

[52] U.S. Cl. 123/119 E; 123/146.5 A; 123/148 AC

[51] Int. Cl.[2] ..... F02M 27/04

[58] Field of Search ..... 123/143 B, 143 C, 148 A, 123/119 E, 148 E, 148 AC, 148 DC

[56] References Cited

UNITED STATES PATENTS

| | | | |
|---|---|---|---|
| 2,451,482 | 10/1948 | Flint | 123/148 DC |
| 2,799,792 | 7/1957 | Flint | 123/148 AC |
| 3,019,276 | 1/1962 | Harlow | 123/148 A |
| 3,613,653 | 10/1971 | Irvin, Jr. et al. | 123/146.5 A |

*Primary Examiner*—Charles J. Myhre
*Assistant Examiner*—Tony Argenbright
*Attorney, Agent, or Firm*—Warren H. Kintzinger

[57] ABSTRACT

A corona coupling system with a plurality of corona coupling unit blocks, individually snapped on spark plug wires and coil wires, interconnected by wire for corona coupling distribution between the spark plug and coil wires. The blocks are interconnected by two generally parallel, insulated wires clamped in place running through each two-piece block by a stamped conductive metal plate having formed-down corners biting into and through insulation on the block interconnecting wires as plastic top and bottom parts of each block are pressed and sonically welded together. The stamped conductive metal plate is formed with a downward longitudinally extended ridge positioned in the blocks so that the bottom edge rests against and along the insulation of the wire on which each block is mounted.

16 Claims, 6 Drawing Figures

ENGINE SPARK IGNITION SYSTEM CORONA COUPLER

Figure 1:
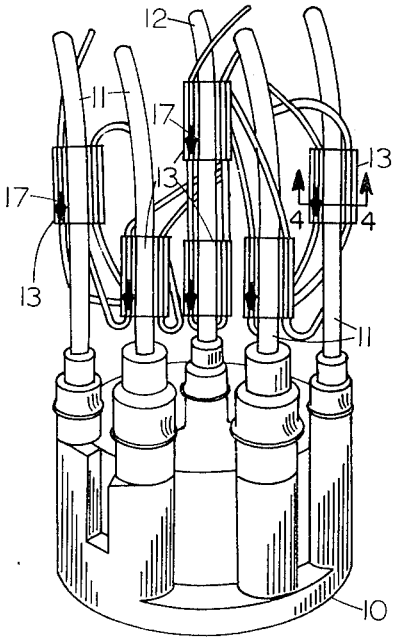

This invention relates in general to spark ignition systems for internal combustion engines and, in particular, to a corona coupler having a plurality of wire interconnected blocks snapped in place on spark plug and coil wires, developing high voltage induced charges, with spark discharge current flow through individual spark plug and coil wires, that is distributed throughout the corona coupler to idle spark plug wires and coupling multiple successive short interval ionizing voltage variation cycles across the points of spark plugs through the time intervals between individual spark plug firings.

In this day of fuel shortages, coupled with increasing fuel costs, anything that helps improve internal combustion spark ignition engine efficiency is worthy of serious consideration. Improved combustion efficiency also results in cleaner burning engines, more pep, and longer engine life. Further, ionization treatment of fuel air charges in cylinders, before spark ignition, results in faster starting and idling smoothness. Such improvements also result in a lowering of undesired, objectionable hydrocarbon exhaust emissions, and prevent carbon build-up. Applicant's corona coupler also extends spark plug life along with a lowering of fuel octane requirements to thereby result in significant savings.

It is, therefore, a principal object of this invention to provide an improved corona coupling system for spark ignition engines, giving improved engine combustion efficiency.

Another object is to acheive significant savings through extended engine and spark plug life, lowered fuel octane requirements, and fuel economy with increased gasoline mileage.

Further objects include the attainment of a cleaner running engine, along with faster starting, and idling smoothness, the prevention of cabon build-up, and improvement in meeting present day exhaust emission requirements.

Features of this invention useful in accomplishing the above objects include, in an engine spark ignition system corona coupler, a plurality of two plastic piece block units enclosing a stamped conductive metal plate and parallel portions of multistranded, insulated wires also interconnecting the plurality of block units of a corona coupler. The block units have a lower portion formed with a longitudinally extended lower channel with thin, flexible walls to facilitate snapping of the blocks on spark plug and coil wires. The block unit lower portions are also formed with two longitudinally extended parallel grooves that contain parallel portions of the multi-stranded insulated wires, interconnecting the block units, with the wires held therein by the block unit upper portions that act like covers. The stamped conductive metal plates have formed-down corners angled to cut through insulation of wires within the block and make direct electrical contact with conductive metal strands of the wires. This is also effective in holding wire in place from endwise movement through the blocks. The plates are also stamp formed with a longitudinally extended ridge that extends downward through a slot in each block unit lower portion, with slot ends acting as stops against endwise movement of the plates in the block units. The bottom edge of each of the longitudinally extended ridge is positioned in each block unit structure so that it rests against and along the insulation of each wire mounting a block unit. This places a conductive metal edge in position for maximizing the cutting of the electro-magnetic lines of force along the length of the metal plate edge during both build-up and collapse of the lines of force, with each heavy spark ignition current flow through a wire. There is some further induced voltage build-up in the conductive members of the corona coupler, directly to the wires running through and interconnecting the blocks, but not as much as induced voltage build-up via the plates. The successively built up and collapsing lines of force result in inductive build-up of voltage levela in the corona coupler to very high levels. The blocks are provided with a direction arrow so that they may be mounted on the spark plug and coil wires in a common direction, in order to avoid induced voltage current flow vectors between coil wire mounted blocks and spark plug wire blocks being in opposition. The plastic pieces of the block units are approximately 60 per cent high impact polypropolene and 40 per cent mixture primarily of talc with fiber, carbon black, and some metallic dust pre-mixed and pelletized before being injection-molded with each pellet being a capsule containing the exact portions of the prescribed mix.

A specific embodiment representing what is presently regarded as the best mode of carrying out the invention is illustrated in the accompanying drawing.

Figure 2:
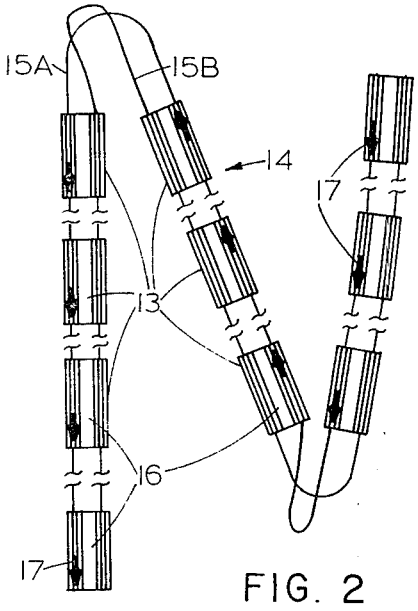
Figure 3A:
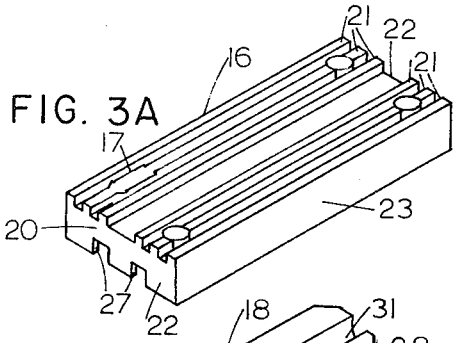
Figure 3B:
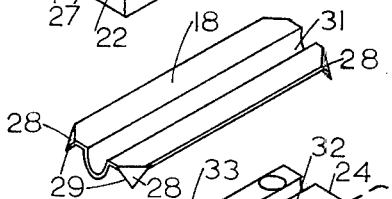
Figure 4:
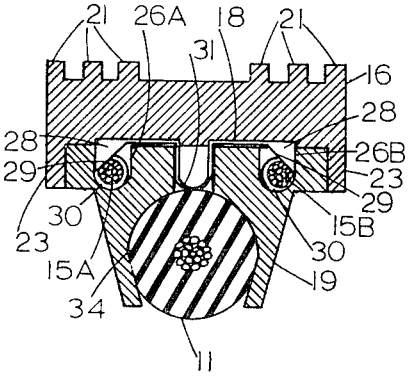
Figure 3C:
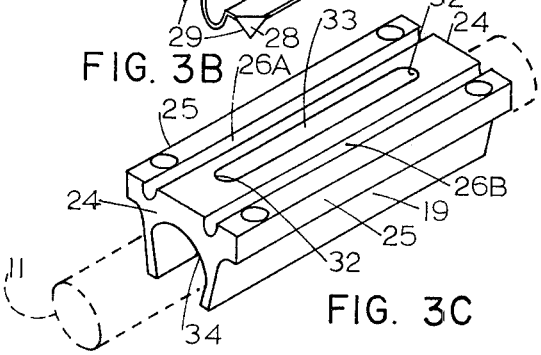

In the drawing:

FIG. 1 represents a partial perspective view of a spark ignition engine distributor cap and wiring with a corona coupling unit;

FIG. 2, a ten-block unit corona coupler;

FIG. 3A, a block unit top portion;

FIG. 3B, a conductive metal plate for a block unit;

FIG. 3C, a block unit lower portion; and,

FIG. 4, a cut-away and sectioned view of a block unit mounted on a wire taken along line 4—4 of FIG. 1.

Referring to the drawing:

The distributor cap 10 of FIG. 1 is shown to have a plurality of spark plug wires 11 (with only those in the foreground shown for clarity) and a coil wire 12 plugged into the top thereof and block units 13 of a corona coupler 14 snap mounted on the spark plug wires 11 and the coil wire 12. Obviously, spark plug wires 11 and the coil wire 12 are part of an internal combustion spark ignition engine (not shown) with the wires cut off instead of spark plugs and other engine parts being shown. The corona coupler 14 is shown in FIG. 2 as having 10 block units 13 all interconnected by two insulated multi-stranded wires 15A and 15B and having block unit portions 16 with directional arrows 17 all oriented in the same direction. The block directional arrows 17 facilitate mounting of the block units 13 of an entire corona coupler 14 on the spark plug and coil wires 11 and 12 (generally two block units 13 on the coil wire and a single block unit 13 on each spark plug wire with an eight cylinder automobile engine ) in a common direction in order that, in all instances, induced voltage current flow vectors between coil wire blocks 13 and spark plug wire blocks will be aiding as opposed to being in opposition. Please note, that with less than eight cylinder engines, six and four cylinder engines, for example, there can be some doubling up of block unit 13 mounting on spark plug wires or extra block units 13 may be cut from the corona coupler 14 by snipping the wires 15A and 15B in appropriate locations.

FIGS. 3A, 3B and 3C portray the three major components of a block unit 13, the top portion 16, an electrically conductive stamped metal plate 18 normally enclosed within each assembled block unit 13, and a block unit lower portion 19, in exploded relation. Referring also to FIG. 4 the top portions 16 of block units 13 each have a body 20 with fluting 21 along with arrow 17 on the top, and front and rear end walls 22 along with side walls 23 that fit down around the top of the ends 24 and sides 25 of a block unit lower portion 19. The corona coupler unit block 13 interconnecting wires 15A and 15B also extend through spaced parallel grooves 26A and 26B extended from end to end in each block unit lower portion 19, and out through notches 27 in end walls 22 of resepctive block unit top portions 16. The stamped conductive metal plates 18 are each formed with four turned down corners 28 having bottom edges 29 slant angled to cut through insulation 30 of wires 15A and 15B and make direct electrical contact with conductive metal strands of the wires. This coupled with endwise restraint of a longitudinally extended downwardly formed ridge 31 of each metal plate 18 by ends 32 of a slot 33 in the lower portion 19, of each block unit 13, limits endwise movement of the plates 18 in block units 13 and holds wires 15A and 15B from endwise movement through the blocks 13. Further, opposite side turned down corners 28 have their bottom edges 29 oppositely slanted so that wire insulation 30 cutting resistive forces are a balanced force action as the block 13 upper and lower portions are press assembled and welded together.

The longitudinally extended downwardly formed ridge 31 extends down through slot 33 in the lower portion 19, of each block unit 13 sufficiently far to generally rest against and along the insulation of each wire mounting a block unit 13. This is with the lower portion 19 of each block unit 13 having a lower longitudinally extended channel 34 with comparatively thin walls with sufficient flex to facilitate snapping of the block units 13 on spark plug and coil wires 11 and 12. With the block units 13 snap mounted on wires and a bottom edge of each plate ridge against its mounting wire a conductive metal edge is in position optimizing the cutting of the electro magnetic lines of force along the length of the metal plate edge during both build-up and collapse of the lines of force respectively at the beginning and end of each very short time interval of heavy spark ignition flow through a wire. While there is some further induced voltage build-up in the conductive wire members 15A and 15B of the corona coupler running through and interconnecting the blocks this does not appear to be as significant as the induced voltage build-up via the ridges 31 of plates 18. The successively built up and collapsing lines of force result in inductive build-up of voltage in the corona coupler to very high levels. This is further enhanced via a voltage potential storage factor attained in the mater mix compounding of the upper and lower portions 16 and 19 of the block units 13. This mater mix is primarily of plastic with the block unit portions 16 and 19 being approximately 60 per cent high impact polypropolene with remaining 40 per cent a mixture primarily of talc with fiber, carbon black and some metallic dust premixed and pelletized before being injection molded with each pellet being, in effect, a capsule containing the exact portions of the prescribed mix. Thus, ingredient stratification does not occur during production of the plastic unit portions 16 and 19, and, particularly with small metal particles dispersed throughout the plastic portions of the block units, additional high level voltage potential storage capacity is advantageously provided.

Thus, an improved corona coupling system is provided for spark ignition engines with high voltage low amperage electro magnetic energy being tapped from the relatively lower voltage high amperage spark generating current flow fed to a firing cylinder and simultaneously through the coil wire of a car's ignition system. The high voltage low amperage electro magnetic energy tapped is injected, in repetitive short interval cycles, into the non-firing cylinders via the spark plugs bombarding non-firing cylinder atmosphere with high voltage corona discharge energy breaking down hydrocarbon molecules and ionizing atoms and molecules contained in the non-firing cylinders.

Whereas this invention is herein illustrated and described with respect to a specific embodiment thereof, it should be realized that various changes may be made without departing from the essential contributions to the art made by the teachings hereof.

I claim:

1. In a corona coupler constructed for use with the ignition system of a spark ignition internal combustion engine having a plurality of firing chambers: a plurality of corona coupling engine blocks adapted to be individually snap-mounted on heavy current wires used as spark plug wires and a coil wire of an internal combustion engine system; insulated wire means interconnecting and running through said plurality of corona coupling unit blocks; an elemental length of conductive means carried by each of said unit blocks in a position to generally parallel and be in close adjacency to the heavy current wire upon which each unit block is mounted; wherein said insulated wire means is two insulated wires interconnecting and running through the plurality of corona coupling unit blocks of the corona coupler; and the portions of said two insulated wires running through unit blocks are contained in spaced parallel end-to-end extended passageway means in each of said unit blocks.

2. The corona coupler of claim 1, wherein said unit blocks have mounting channels for mounting of the unit blocks on heavy current wires, with the portions of said insulated wires running through the unit blocks substantially parallel to the respective heavy current wire upon which each of the blocks is mounted.

3. The corona coupler of claim 2, wherein said elemental length of conductive means is the bottom of a longitudinally extended ridge of a stamped conductive metal plate one of which is mounted in each of said blocks.

4. The corona coupler of claim 3, wherein each of said stamped conductive metal plates has formed over edges that are angled to cut through insulation of said insulated wires.

5. The corona coupler of claim 4, wherein said plate formed over edges are stamped conductive metal plate formed-down corners angled to cut through insulation and make direct electrical contact with conductive metal of said insulated wires.

6. The corona coupler of claim 5, wherein said unit blocks are two-piece plastic blocks with each enclosing a stamped conductive metal plate.

7. The corona coupler of claim 6, wherein said stamped conductive metal plate turned down corners cut through insulated wire insulation as the two pieces of a unit block are pressed together during corona coupler unit block assembly.

8. The corona coupler of claim 7, wherein said two-piece unit blocks have an upper portion; and a lower portion with a heavy current wire mounting channel at the bottom.

9. The corona coupler of claim 8, wherein said unit block upper portion and lower portion enclose one of said stamped conductive metal plates; and said lower portion has a slot receiving said longitudinally extended ridge of a stamped conductive metal plate.

10. The corona coupler of claim 9, wherein when said unit block is mounted on an insulated heavy current wire the longitudinally extended ridge of a stamped conductive metal plate extends through said slot in said lower portion into substantially contiguous contact with insulation on the heavy current wire mounting the unit block.

11. The corona coupler of claim 6, wherein said two-piece plastic blocks are approximately sixty per cent high impact plastic mixed with approximately forty per cent mixture primarily of talc with fiber, carbon black and some metallic dust.

12. The corona coupler of claim 11, wherein said two-piece plastic block members are injection molded from a pre-mixed and pelletized mix, with each pellet being a capsule containing the exact portions of the prescribed mix.

13. The corona coupler of claim 11, wherein said high impact plastic is polypropolene.

14. In a corona coupler constructed for use with the ignition system of a spark ignition internal combustion engine having a plurality of firing chambers: a plurality of corona coupling unit blocks adapted to be individually snap-mounted on heavy current wires used as spark plug wires and a coil wire of an internal combustion engine system; insulated wire means interconnecting and running through said plurality of corona coupling unit blocks; an elemental length of conductive means carried by each of said unit blocks in a position to generally parallel and be in close adjacency to the heavy current wire upon which each unit block is mounted; and wherein said corona coupling unit blocks are approximately 60 per cent high impact plastic mixed with approximately 40 per cent mixture primarily of talc with fiber, carbon black and some metallic dust.

15. The corona coupler of claim 14, wherein the corona coupling unit block members are injection molded from a pre-mixed and pelletized mix, with each pellet containing the exact portions of the prescribed mix.

16. In a corona coupler constructed for use with the ignition system of a spark ignition internal combustion engine having a plurality of firing chambers: a plurality of corona coupling unit blocks adapted to be individually snap-mounted on heavy current wires used as spark plug wires and a coil wire of an internal combustion engine system; insulated wire means interconnecting and running through said plurality of corona coupling unit blocks; an elemental length of conductive means carried by each of said unit blocks in a position to generally parallel and be in close adjacency to the heavy current wire upon which each unit block is mounted; and wherein said elemental length of conductive means is the bottom of a longitudinally extended ridge of a stamped conductive metal plate one of which is mounted in each of said blocks.

* * * * *